US006805576B2

(12) United States Patent
Feye-Hohmann et al.

(10) Patent No.: US 6,805,576 B2
(45) Date of Patent: Oct. 19, 2004

(54) DEVICE FOR ELECTRICALLY CONNECTING CONTACT POINTS ON NEIGHBORING CIRCUIT BOARDS

(75) Inventors: Juergen Feye-Hohmann, Detmold (DE); Ralf Beckmann, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 10/427,678

(22) Filed: May 1, 2003

(65) Prior Publication Data

US 2003/0228775 A1 Dec. 11, 2003

(30) Foreign Application Priority Data

Jun. 5, 2002 (DE) ..... 102 24 841

(51) Int. Cl.[7] ..... H01R 11/20; H01R 4/24

(52) U.S. Cl. ..... 439/404; 439/65

(58) Field of Search ..... 439/65, 75, 389, 439/391, 393, 395, 400, 404–406, 417, 418, 694, 902, 701, 717, 594, 402

(56) References Cited

U.S. PATENT DOCUMENTS 4,391,484 A * 7/1983 Foederer ..... 439/404
4,820,169 A * 4/1989 Weber et al. ..... 439/65
4,900,258 A * 2/1990 Hnatuck et al. ..... 439/63
4,938,719 A * 7/1990 Sawai et al. ..... 439/714
5,888,089 A * 3/1999 Konoya et al. ..... 439/404
6,050,845 A * 4/2000 Smalley et al. ..... 439/417
6,149,453 A * 11/2000 Hollesen et al. ..... 439/395

* cited by examiner

*Primary Examiner*—Gary Paumen
*Assistant Examiner*—Felix O. Figueroa
(74) *Attorney, Agent, or Firm*—Charles E. Baxley

(57) ABSTRACT

The device is used for electrically connecting at least one contact point on a first circuit board to at least one contact point on a second circuit board positioned neighboring the first circuit board using at least one conductor provided with an insulating sheath. In order to be able to construct and handle such a device simply, cutting contacts are positioned fixed on a relevant circuit board at contact points and have cutters implemented at contact points for contacting the conductor without stripping. A housing receives the conductor and tightly encloses it and has a conductor insertion opening on a long side thereof which extends over a respective conductor length. Guide contours on both sides on inner sides adjoining the conductor insertion opening run transversely to a housing lengthwise direction and are recessed relative to lateral conductor bearing surfaces on the inner sides and are tailored to a recess of the contact legs which are provided with the cutters of the cutting contacts.

33 Claims, 4 Drawing Sheets

DEVICE FOR ELECTRICALLY CONNECTING CONTACT POINTS ON NEIGHBORING CIRCUIT BOARDS

BACKGROUND OF THE INVENTION

1. Field of the Invention

The present invention relates to a device for electrically connecting contact points. More particularly, the present invention relates to a device for electrically connecting contact points on neighboring circuit boards.

2. Description of the Prior Art

Circuit board connectors, which are metal molded parts, exist for electrically connecting a contact point on a first circuit board to a contact point on a second circuit board. If the contact points to be electrically connected are positioned on circuit boards which are at an angle to one another, the circuit board connectors are prepared in cross-section at a region provided for necessary angling in such a way that they may assume the angle by bending after attachment on the first circuit board for connection to the contact point on the second circuit board.

BRIEF SUMMARY OF THE INVENTION

The present intention is based on the object of providing a device which is not only simply constructed, but is also simple to handle.

It is significant for the present invention that a simple sheathed conductor, which is easily available unlike a metal molded part, is used for electrical connection of contact points on circuit boards. Cutting contacts provided for contacting the sheathed conductor are soldered at solder points of the conductors of the circuit board. This is preferably performed after components of the circuit board are equipped, so that the circuit board may be pushed over a solder wave afterward. On the other hand, there is also a possibility of pressing the cutting contacts into the circuit board. However, care must be taken that the cutting contacts to be connected to one another via the conductor are aligned with a housing which accommodates the conductor. This applies above all if two or more cutting contacts are provided for each circuit board, which may be expedient depending on power load. A relevant conductor is either laid on the cutting contact or laid in the housing, and the housing is then pulled over the cutting contacts, with contact legs of the cutting contacts being received in inside guide contours of the housing and the conductor being pushed onto the cutting contacts until a final position of the cutting contacts inside the housing is reached in such a way that electrical contact is produced while cutting through the insulating sheath of the conductor.

This also functions if the cutting contacts to be connected to one another are positioned on circuit boards at an angle to one another, typically at a right angle to one another. A housing which may be angled is then provided.

DETAILED DESCRIPTION OF THE INVENTION

Figure 1:
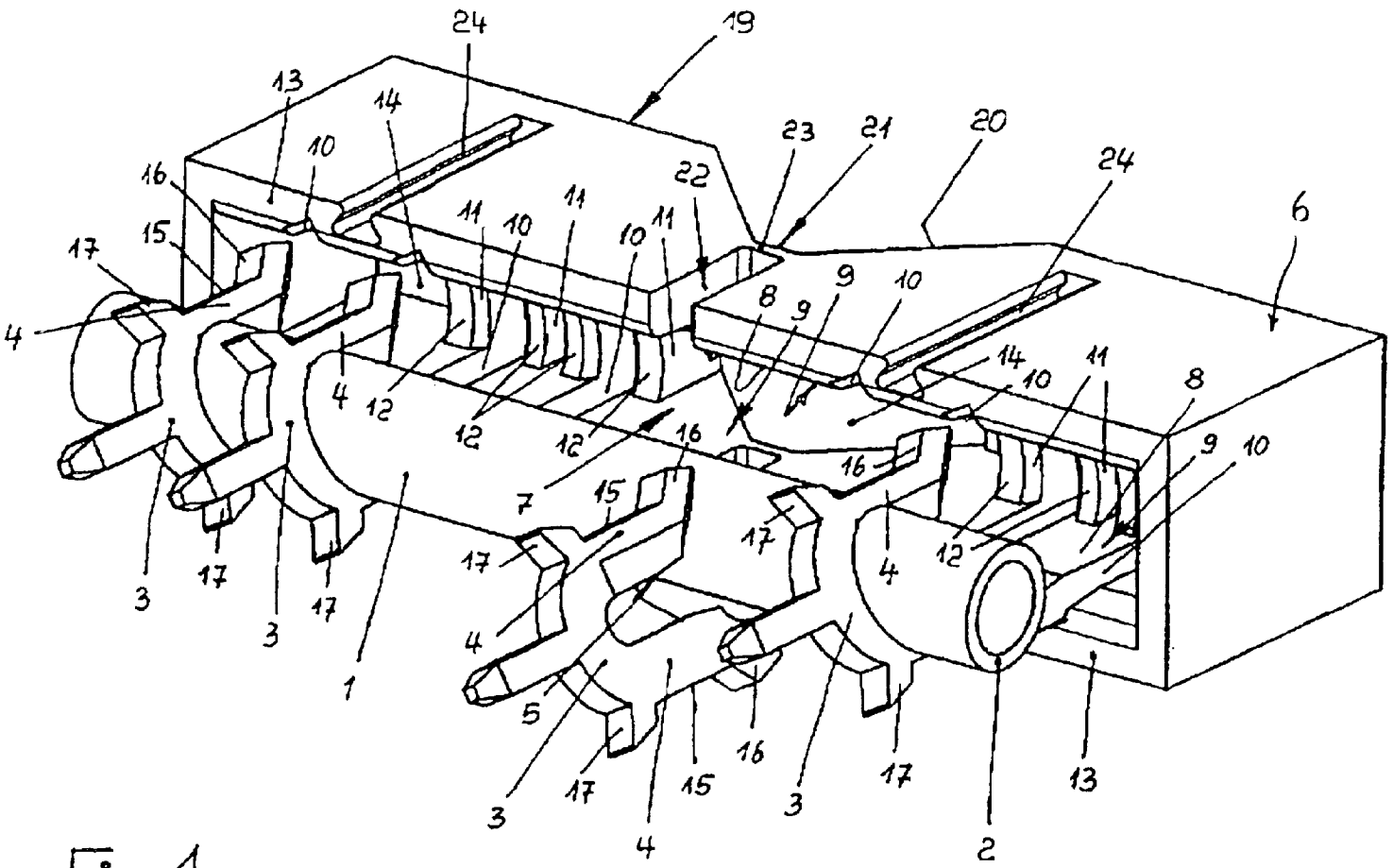
FIG. 1 shows a perspective illustration of the device of the present invention for connecting contact points of two circuit boards.

FIG. 1 shows an electrical conductor 1, which has a typical metal core enclosed by an insulating sheath 2. Using cutting contacts 3, the metal core of the electrical conductor may be contacted without stripping. Each cutting contact 3 has two contact legs 4 which are positioned opposite to one another and essentially parallel, and which have cutters 5 on their sides which face one another which cut through the insulating sheath 2 when the electrical conductor 1 is pushed between the contact legs 4. Two of the cutting contacts 3 at a time are positioned on a circuit board in an exemplary embodiment and soldered in there or pressed in to form a contact. In this case, insertion openings are between the contact legs 4 of the cutting contacts 3 in an alignment corresponding to an alignment of the electrical conductor 1 to be contacted.

A housing 6, which may be pushed onto the cutting contacts 3, is provided for receiving the electrical conductor 1 including the cutting contacts 3. This is performed after the electrical conductor 1 is either laid on the insertion openings between the contact legs 4 of the cutting contacts 3 or is inserted into the housing 6. Relative displacement between the electrical conductor 1 and the cutters 5 of the contact legs 4 of the cutting contacts 3, through which contact is produced, occurs when the housing 6 is pushed onto the cutting contacts 3.

Figure 2:
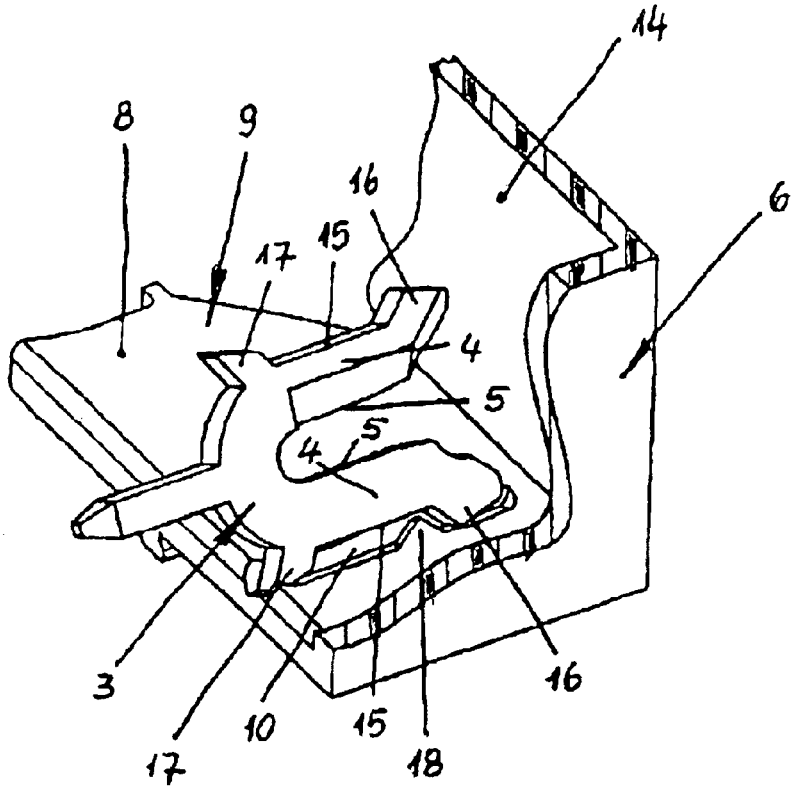
FIG. 2 shows a detail of the device of the present invention shown in FIG. 1 in a perspective view.

The housing 6 preferably has an inner length which corresponds to a length of the electrical conductor 1. For insertion of the electrical conductor 1 and the cutting contacts 3, the oblong housing 6 has an insertion opening 7 on its long side which is adjoined by diametrically opposing inner sides 8 of lateral walls 13 of the housing 6. The inner sides 8 of the lateral walls 13 of the housing 6 at least partially form conductor support surfaces 9, whose distance to one another is essentially equal to a diameter of the electrical conductor 1. Guide contours 10, like inset grooves for the electrical conductor 1, which extend transversely to a lengthwise direction of the housing 6 and therefore in an insertion direction of the electrical conductor 1 and the cutting contacts 3, are implemented on the inner sides 8 of the lateral walls 13 of the housing 6 at the conductor support surfaces 9 on both sides. The guide contours 10 are thus used to receive the cutting contacts 3, whose contact legs 4 have an envelope contour with a square or rectangular shape. At cuter edges 15 of the contact legs 4 of the cutting contacts 3, a locking tab 16 projects between the contact legs 4 near the insertion opening 7, and a further tab 17 projects outward near a rear connection bridge. When the housing 6 is pushed onto the cutting contacts 3, the locking tabs 16 and the tabs 17 are guided in the guide contours 10 on the inner sides 8 of the lateral walls 13 of the housing 6. The guide contours 10 are V-shaped grooves. In order that the housing 6 and the cutting contacts 3 may be locked with one another, a locking step 18 is located near an inner end in the guide contours 10, behind which the locking tab 16 on the outer edges 15 of the contact legs 4 of the cutting contacts 3 may snap in, as illustrated in FIG. 2.

Inside of the housing 6, support ribs or webs 11 project in a direction toward the insertion opening 7, from a side of the housing 6 opposite the insertion opening 7. Faces of the support webs 11 form conductor support surfaces 12, which are positioned toward the insertion opening 7 and against which the electrical conductor 1 pushed into the housing 6 comes to rest. In order that a desired relative displacement between the cutting contacts 3 and the electrical conductor 1, which only begins upon joining, occurs as soon as the electrical conductor 1 has come to rest on the conductor support surfaces 12 of the support webs 11, the guide contours 10 on the inner sides 8 of the lateral walls 13 of the housing 6 extend away from the insertion opening 7 in a depth direction of the housing 6 over the conductor support surfaces 12 of the support webs 11. Thus, in an assembled arrangement, when the electrical conductor 1 rests on the conductor support surfaces 12 of the support webs 11, the projecting locking tabs 16 of the contact legs 4 of the cutting contacts 3 extend almost up to a rear wall 14 of the housing 6, which may be provided for both stability and insulation reasons. The entire housing 6 is made of an insulating plastic.

Furthermore, an indentation or recess 20, which is a V-shaped groove extending over an entire width of the housing 6, may be seen in FIG. 1, is shaped into a rear side 19 of the housing 6 opposite the insertion opening 7. The recess 20, which accordingly runs transversely to a lengthwise direction of the housing 6, follows the rear wall 14 possibly positioned on the rear side 19 of the housing 6. In a same way, the lateral walls 13 of the housing 6 have a contour of the recess 20, whose sides are at an angle of 90 degrees to one another in the present case. The recess 20 has a flattened crown 21 which adjoins a flexible web 23 which is shaped into the plastic material of the housing 6 in one piece. In an extension of a plane of symmetry of the recess 20 running in a transverse direction to the housing 6, there is a slot 22 in a region of each of the lateral walls 13 which extends from the insertion opening 7 of the housing 6 out in a transverse housing direction and up to the flexible web 23.

Figure 3:
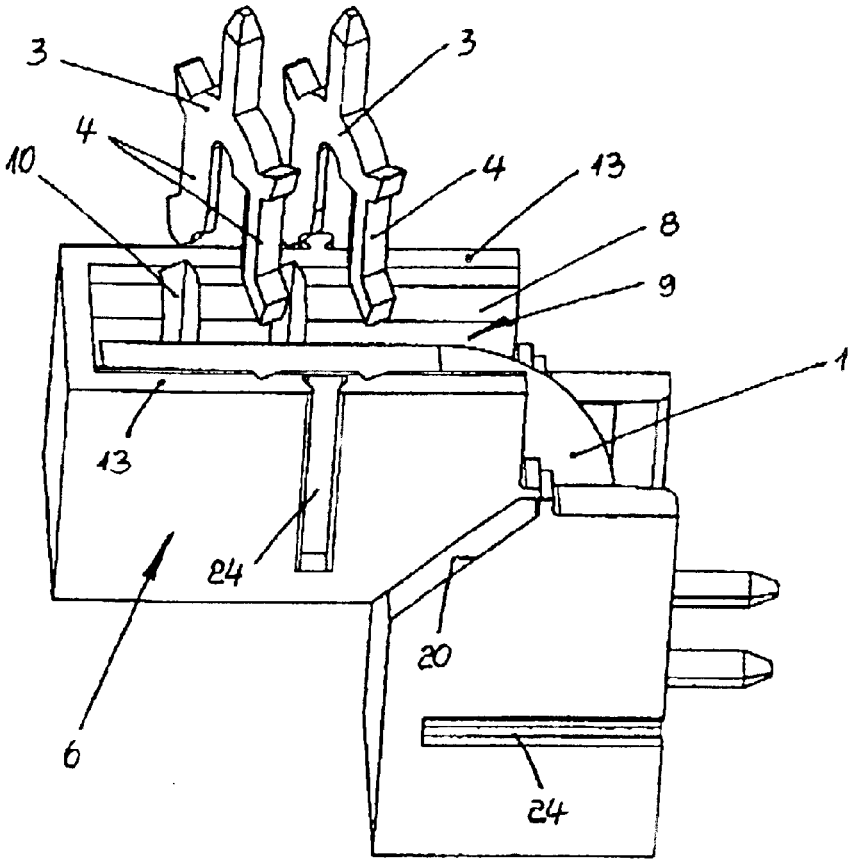
FIG. 3 shows a perspective illustration of the device of the present invention shown in FIG. 1 in a position angled by 90 degrees.
Figure 4:
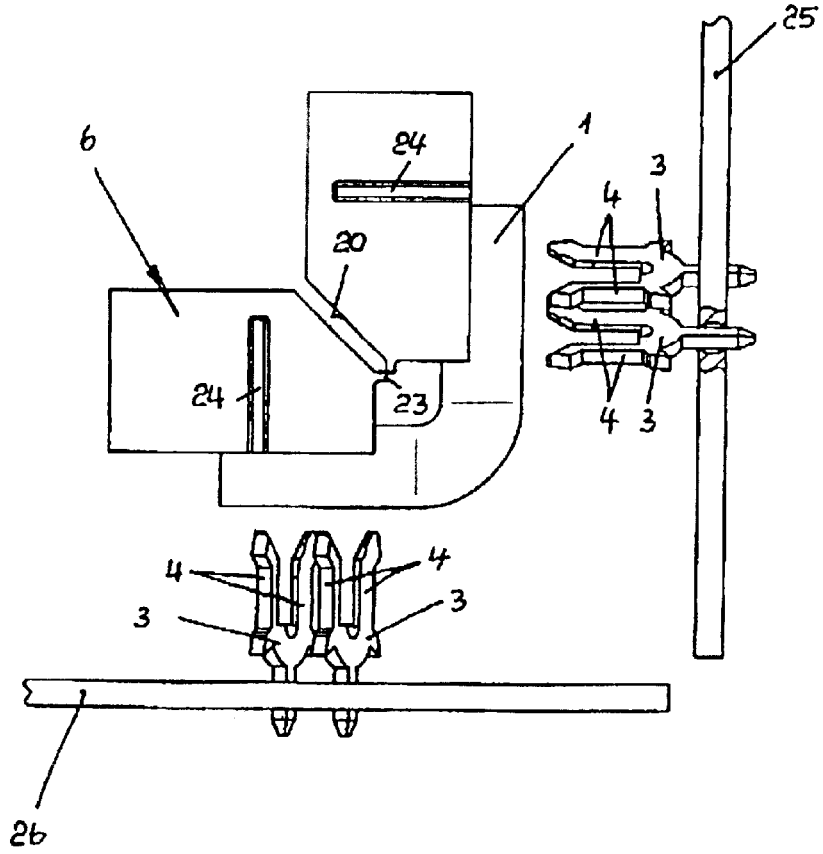
FIG. 4 shows a schematic top view of the angled device of the present invention from FIG. 3 with an illustration of two circuit boards at an angle to one another.

FIGS. 3 and 4 illustrate that the housing 6 may be angled by 90 degrees or possibly by another angle, the flexible web 23 which is formed by a part of the rear wall 14 functions like a film hinge. Like the housing 6, the electrical conductor 1 which is flexible anyway may be angled in a same way and as illustrated in FIG. 4 the contact points 3 which are positioned on two circuit boards 25 and 26 which are at an angle to one another enclose an angle of 90 degrees with one another, may thus be connected to one another.

In a variation of the drawing, for a data connection between two circuit boards, it may be sufficient to provide each circuit board with only one single cutting contact 3. For power connections between the circuit boards for which larger conductor cross-sections are typically provided, power may be transmitted on multiple cutting contacts 3 for which two cutting contacts 3 are present on each circuit board in the exemplary embodiment illustrated.

Folding or angling point of the housing 6, which is predetermined by position of the recess 20 and the slot 22, may also be provided in a place other than a transverse center of the housing 6. For example, the housing 6 may be angled if one section of the housing 6 including the electrical conductor 1 is already locked onto the cutting contacts 3 of one circuit board, after which the other housing section is then angled while taking along the electrical conductor 1 and pulled over a relevant cutting contact 3 of the second circuit board. In this case, the entire device may be provided with elasticity such that the tabs 16 and 17 of the cutting contacts 3 are located in the guide contours 10 on the inner sides 8 of the lateral walls 13 of the housing 6.

Tongue and groove elements 24 are shaped onto outer sides of the lateral walls 13 of the housing 6 in a transverse direction of the housing 6, which arc used for a mechanical connection of a housing 6 to a second housing 6 if two or more connections of the present type are provided lying next to one another in parallel.

What is claimed is:

1. A device for electrically connecting at least one contact point on a first circuit board to at least one contact point on a second circuit board using at least one conductor (1), wherein the second circuit board is positioned neighboring the first circuit board, and wherein the at least one conductor is provided with an insulating sheath (2), comprising:

a) cutting contacts (3) for being positioned fixed at the contact points on a relevant circuit board, and having cutters (5) implemented at contact legs (4) thereof for contacting the conductor (1) without stripping; and b) a housing (6) for receiving the conductor (1) and tightly enclosing the conductor (1), and having:

a) a conductor insertion opening (7) disposed in a long side of the housing (6) and extending over a respective conductor length;

b) guide contours (10) disposed on both sides on inner sides (8) of the housing (6) adjoining the conductor insertion opening (7) in the housing (6), running transversely to a housing lengthwise direction, being recessed relative to lateral conductor bearing surfaces (9) on the inner sides (8) of the housing (6), and being tailored to a recess of the contact legs (4) of the cutting contacts (3), wherein the contact legs (4) of the cutting contacts (3) are provided with the cutters (5);

c) at least one angled recess (20) disposed in a side of the housing (6) furthest from the conductor insertion opening (7) in the housing (6) and has a crown (21) extending over a width of the housing (6) and from a back side (19) of the housing (6) up into both lateral walls (13) of the housing (6); and d) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

2. A device for electrically connecting at least one contact point on a first circuit board to at least one contact point on a second circuit board using at least one conductor (1), wherein the second circuit board is positioned neighboring the first circuit board, and wherein the at least one conductor is provided with an insulating sheath (2) and electrically conductive ends, comprising:

a) cutting contacts (3) being positioned fixed at the contact points on a relevant circuit board, and having cutters (5) implemented at contact legs (4) thereof for contacting the conductor (1) without stripping; and b) a housing (6) for receiving the conductor (1) and tightly enclosing the conductor (1), and having:

i) a conductor insertion opening (7) disposed in a long side of the housing (6) and extending over a respective conductor length;

ii) guide contours (10) disposed on both sides on inner sides (8) of the housing (6) adjoining the conductor insertion opening (7) in the housing (6), running transversely to a housing lengthwise direction, being recessed relative to lateral conductor bearing surfaces (9) on the inner sides (8) of the housing (6), and being tailored to a recess of the contact legs (4) of the cutting contacts (3), wherein the contact legs (4) of the cutting contacts (3) are provided with the cutters (5), wherein the cutting contacts (3) are not directly attached to each other; and iii) end walls completely containing the conductor (1) end-to-end therebetween wherein the end walls of the housing (6) are completely closed for protecting the electrically conductive ends of the conductor (1) facing the end walls of the housing (6).

3. The device according to claim 2, wherein support webs (11) for supporting the conductor (1) have conductor support surfaces (12) projecting in a direction toward the conductor insertion opening (7) in the housing (6) over inner end regions of the guide contours (10) for the contact legs (4) of the cutting contacts (3), and are positioned on the inner side of the housing (6) lying opposite the conductor insertion opening (7) in the housing (6) in a depth direction.

4. The device according to claim 2, wherein the guide contours (10) positioned on opposite housing inner sides (8) of the housing (6) are parallel to one another.

5. The device according to claim 4, wherein the housing (6) is U-shaped in cross-section and correspondingly has:

a) lateral walls (13) parallel to one another and have the inside guide contours (10) thereon; and b) a rear wall (14) perpendicular to the lateral walls (13) of the housing (6) and opposite the conductor insertion opening (7) in the housing (6).

6. The device according to claim 4, wherein each cutting contact (3) has two contact legs (4) with a shared square or rectangular envelope shape.

7. The device according to claim 6, wherein outer edges (15) of the contact legs (4) of the cutting contacts (3) are receivable in a join direction in a press fit in the guide contours (10) on the opposing housing inner sides (8) of the housing (6).

8. The device according to claim 5, 6, or 7, wherein the housing (6) has undercut tongue and groove elements (24) on the outer sides of its lateral walls (13), running in a depth direction for a mechanical connection to a neighboring housing (6) having identical coupling undercut tongue and groove elements (24).

9. The device according to claim 5, 6 or 7, wherein the housing (6) has:

a) at least one angled recess (20) disposed in a side of the housing (6) furthest from the conductor insertion opening (7) in the housing (6) and has a crown (21) extending over a width of the housing (6) and from a back side (19) of the housing (6) up into both lateral walls (13) of the housing (6); and b) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

10. The device according to claim 9, wherein the housing (6) has undercut tongue and groove elements (24) on the outer sides of its lateral walls (13), running in a depth direction for a mechanical connection to a neighboring housing (6) having identical coupling undercut tongue and groove elements (24).

11. The device according to claim 6 or 7, wherein the outer edge (15) of each contact leg (4) of each cutting contact (3) which lies in the join direction has tabs (16, 17) projecting outward which are receivable in an associated guide contour (10) on opposing housing inner sides (8) of the housing (6).

12. The device according to claim 11, wherein at least one of the tabs (16, 17) is implemented as a locking tab on the outer edges (15) of the contact legs (4) of the cutting contacts (3), and locking steps (18) which work together with the locking tabs (17) are positioned in the guide contours (10) on the opposing housing inner sides (8) of the housing (6).

13. The device according to claim 11, wherein the housing (6) has:

a) at least one angled recess (20) disposed on a side of the housing (6) furthest from the conductor insertion opening (7) in the housing (6) and has a crown (21) extending over a width of the housing (6) and from a back side (19) of the housing (6) up into both lateral walls (13) of the housing (6); and b) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

14. The device according to claim 11, wherein the housing (6) has undercut tongue and groove elements (24) on outer sides of its lateral walls (13) running in a depth direction for a mechanical connection to a neighboring housing (6) having identical coupling undercut tongue and groove elements (24).

15. The device according to claim 5, wherein each cutting contact (3) has two contact legs (4) with a shared square or rectangular envelope shape.

16. The device according to claim 15, wherein outer edges (15) of the contact legs (4) of the cutting contacts (3) are receivable in a join direction in a press fit in the guide contours (10) on opposing housing inner sides (8) of the housing (6).

17. The device according to claim 16, wherein the housing (6) has:

a) at least one angled recess (20) disposed in a side of the housing (6) furthest from the conductor insertion opening (7) in the housing (6) and has a crown (21) extending over a width of the housing (6) and from aback side (19) of the housing (6) up into both lateral walls (13) of the housing (6); and b) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

18. The device according to claim 20, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

19. The device according to claim 16, wherein the outer edge (15) of each contact leg (4) of each cutting contact (3) which lies in the join direction has tabs (16, 17) projecting outward which are receivable in an associated guide contour (10) on opposing housing inner sides (8) of the housing (6).

20. The device according to claim 19, wherein the housing (6) has:

a) at least one angled recess (20) disposed on a side of the housing (6) furthest from the conductor insertion opening (7) in the housing (6) and has a crown (21) extending over a width of the housing (6) and from a back side (19) of the housing (6) up into both lateral walls (13) of the housing (6); and b) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

21. The device according to claim 19, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

22. The device according to claim 19, wherein at least one of the tabs (16, 17) is implemented as a locking tab on the outer edges (15) of the contact legs (4) of the cutting contacts (3), and locking steps (18) which work together with the locking tabs (17) are positioned in the guide contours (10) on the opposing housing inner sides (8) of the housing (6).

23. The device according to claim 22, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

24. The device according to claim 22, wherein the housing (6) has:

a) at least one angled recess (20) disposed in a side of the housing (6) furthest from the conductor insertion opening (7) in the housing (6) and has a crown (21) extending over a width of the housing (6) and from a back side (19) of the housing (6) up into both lateral walls (13) of the housing (6); and b) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

25. The device according to claim 24, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

26. The device according to claim 15, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

27. The device according to claim 15, wherein the outer edge (15) of each contact leg (4) of each cutting contact (3) which lies in the join direction has tabs (16, 17) projecting outward which are receivable in an associated guide contour (10) on opposing housing inner sides (8) of the housing (6).

28. The device according to claim 27, wherein the housing (6) has:

a) at least one angled recess (20) disposed on a side of the housing (6) furthest from the conductor insertion opening (7) in the housing (6) and has a crown (21) extending over a width of the housing (6) and from a back side (19) of the housing (6) up into both lateral walls (13) of the housing (6); and b) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

29. The device according to claim 27, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

30. The device according to claim 27, wherein at least one of the tabs (16, 17) is implemented as a locking tab on the outer edges (15) of the contact legs (4) of the cutting contacts (3), and locking steps (18) which work together with the locking tabs (17) are positioned in the guide contours (10) on the opposing housing inner sides (8) of the housing (6).

31. The device according to claim 30, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

32. The device according to claim 30, wherein the housing (6) has:

a) at least one angled recess (20) disposed in a side of the housing (6) furthest from the conductor insertion opening (7) in the housing (6) and has a crown (21) extending over a width of the housing (6) and from a back side (19) of the housing (6) up into both lateral walls (13) of the housing (6); and b) a slot (22) lying centrally to the housing (6) in the lateral walls (13) of the housing (6) and extending from the conductor insertion opening (7) in the housing (6) into the lateral walls (13) of the housing (6) up to near the crown (21) of the recess (20) to form a residual, flexible web (23).

33. The device according to claim 32, wherein the housing (6) has undercut tongue and groove elements (24) on outer sides of lateral walls (13) of the housing (6) running in a depth direction for a mechanical connection to a neighboring housing (6) having identical coupling undercut tongue and groove elements (24).

* * * * *